United States Patent [19]

Hume

[11] 4,044,088

[45] Aug. 23, 1977

[54] STRESSED HOLLOW CONCRETE CYLINDERS

[76] Inventor: Graeme Reginald Hume, 5 Ian's Grove, Lower Templestowe, 3107 Victoria, Australia

[21] Appl. No.: 635,224

[22] Filed: Nov. 25, 1975

Related U.S. Application Data

[63] Continuation-in-part of Ser. No. 386,619, Aug. 9, 1973, abandoned.

[30] Foreign Application Priority Data

Aug. 10, 1972 Australia ..... 36/72
July 30, 1975 Australia ..... 2565/75

[51] Int. Cl.[2] ..... B28B 23/12

[52] U.S. Cl. ..... 264/130; 138/176; 264/135; 264/228; 264/314; 425/111; 52/224

[58] Field of Search ..... 264/130, 135, 313, 314, 264/228; 138/176; 249/152, 178, 180; 425/111; 52/223 R, 224

[56] References Cited

U.S. PATENT DOCUMENTS

| | | | |
|---|---|---|---|
| 376,748 | 1/1888 | Meehan | 264/297 |
| 2,185,749 | 1/1940 | Kennedy | 246/228 |
| 3,390,211 | 6/1968 | Ziegler | 264/228 X |

*Primary Examiner*—Thomas P. Pavelko
*Attorney, Agent, or Firm*—Schuyler, Birch, Swindler, McKie & Beckett

[57] ABSTRACT

The production of a moulded stressed concrete pipe in which stressed coated tendons are completely embedded in the finished article. The pipe is moulded in at least one longitudinal segment joined only by helically concentrically positioned tendons. The cured segments are then expanded radially to stretch and stress the tendons, the gap formed between the segments being filled with filler material to maintain the stress in the tendons. There is also disclosed a method where the tendons are stressed on a former prior to immersion of the tendons and former in a concrete pour. The former is segmented and collapsible so that the tension in the tendons can be transferred from the former to the concrete when it has cured, thus forming a stressed pipe structure.

9 Claims, 7 Drawing Figures

FIG.7.
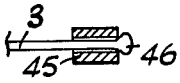
FIG.2.
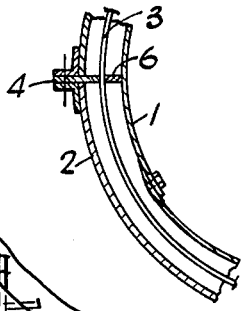
FIG.6.
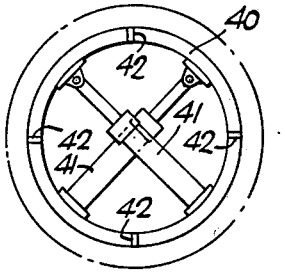
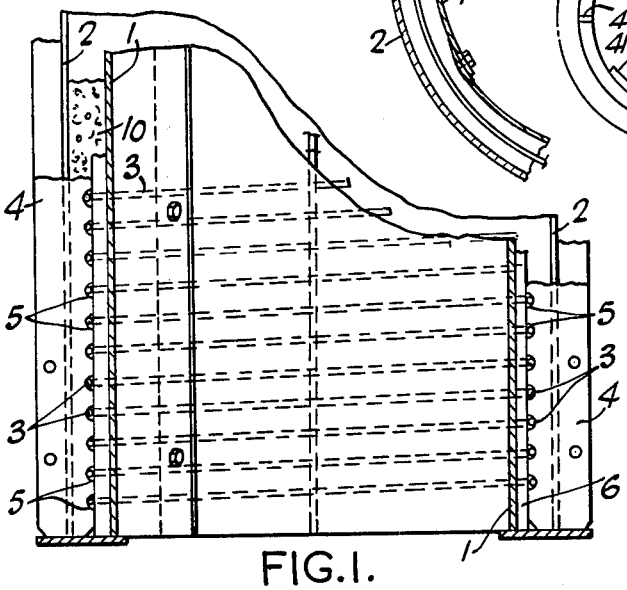
FIG.1.
FIG.5.
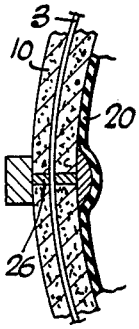
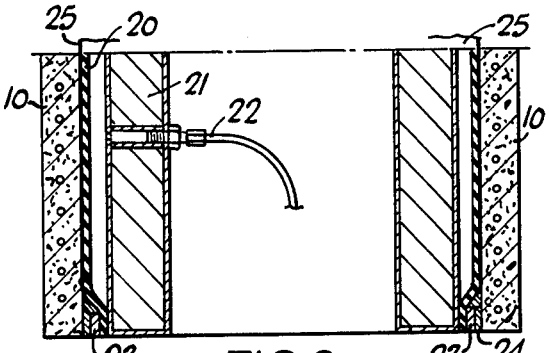
FIG.3.
FIG.4.
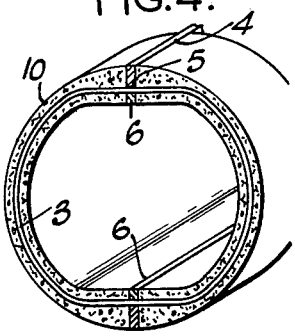

STRESSED HOLLOW CONCRETE CYLINDERS

RELATED APPLICATION

This application is a Continuation-in-Part of my copending application Ser. No. 386,619 filed Aug. 9, 1973 now abandoned.

BACKGROUND OF INVENTION

This invention relates to the production of hollow concrete cylinders in which the concrete forming the cylinder is maintained under stress by high tensile strength steel wires or strands sometimes called tendons.

It is usual to form the cylinder and subsequently to fit a tendon in wrap around fashion under stress onto the outer surface. The tendon is then fixed and encased in grouting material such as gunite. Other systems are known in which the tendons are at least partially enclosed in the parent concrete of the cylinder, however, total enclosure is not possible and furthermore, these systems suffer because of their complexity.

It is a principal objective of the present invention to provide a stressed hollow concrete cylinder in which the stressing medium is totally enclosed by concrete which forms the cylinder whole.

SUMMARY OF INVENTION

According to the present invention, there is provided a method of producing a concrete pipe comprising the steps of:

substantially continuously coating a stressable tendon with an anti-bonding material such that the outer surface of said tendon closely contacts the inner surface of said anti-bonding material with no gaps present therebetween, said anti-bonding material being of sufficient strength to withstand without failure the compressive load applied thereupon by said tendon to preclude relative radial movement of said tendon with respect to said coating material while assuring low friction relative circumferential movement of said tendon with respect to the cured concrete, installing at least one coated unstressed tendon in a concrete pipe mould prior to pouring of concrete, the tendon extending substantially concentrically relative to the walls of the mould and being secured to tendon anchorages positioned within the mould, said mould having at least one longitudinal divider so that the pipe to be cast therein has at least one longitudinal split, portions of said tendon lying on both sides of said split and being connected together across said split, pouring concrete into said mould to substantially completely immerse said tendon and said anchorages in said concrete except for those points wherein said tendon passes through said longitudinal split, so that concrete surrounds and intimately contacts said coating material with no gaps therebetween to preclude relative radial movement of said coating material with respect to said concrete after curing the concrete in the mould, expanding said pipe radially outwardly to cause circumferential movement of said tendon with respect to the cured concrete to thereby stress the tendon, and filling the split in said mould with a filler to form a substantially continuous stressed cylinder.

In another aspect of the present invention, there is provided a method of stressing a substantially circular tendon comprising the steps of:

substantially continuously coating a stressable tendon with an anti-bonding material such that the outer surface of said tendon intimately contacts the inner surface of said anti-bonding material with no gaps present therebetween, said anti-bonding material being of sufficient strength to withstand without excessive failure the compressive load applied thereupon by said tendon to preclude relative radial movement of said tendon with respect to said coating material while assuring low friction relative circumferential movement of said tendon with respect to the cured concrete, installing at least one coated unstressed tendon in a concrete pipe mould prior to pouring of concrete, the tendon extending substantially concentrically relative to the walls of the mold and secured to tendon anchorages positioned within the mould, said mould having at least one longitudinal split, portions of said tendon lying on both sides of said split and being connected together across said split, pouring concrete into said mould to substantially completely immerse said tendon and said anchorages in said concrete except for those points wherein said tendon passes through said longitudinal split, so that concrete surrounds and intimately contacts said coating material with no gaps therebetween to preclude relative radial movement of said coating material with respect to said concrete after curing the concrete in the mould, expanding said pipe radially outwardly to cause circumferential movement of said tendon with respect to the cured concrete to thereby stress the tendon, and filling the split in said mould with a filler to form a substantially continuous stressed cylinder.

BRIEF DESCRIPTION OF DRAWINGS

The invention will be described in greater detail having reference to the accompanying drawings in which:

FIG. 1 is a part elevational sectional view showing a mould formwork for production of a concrete pipe, FIG. 2 is a partial end view of the formwork of FIG. 1, FIG. 3 is a part elevational view of a segment expansion apparatus, FIG. 4 is a cross-sectional view of a modified moulded pipe segment and wire on a reduced scale, FIG. 5 is a part sectional end view showing the gap formed between segmented portions, FIG. 6 is an end view showing a modified form of the invention wherein the tendons are prestressed prior to moulding and curing of concrete, FIG. 7 shows a view of an end of a tendon for anchoring in a concrete pipe.

DETAILED DESCRIPTION OF INVENTION

Referring to FIGS. 1 and 2 of the drawings, formwork comprising inner section 1 and outer section 2 is provided. During a moulding operation, the formwork would be arranged vertically for pouring of concrete into the annular space between the inner and outer mould sections. Circumferential wires or tendons 3 are positioned within the annular space and held in helical relation by comb plates 4 which also form dividers to segmentalise the annular concrete section into say two halves. Furthermore, reinforcing steel (not shown) may be positioned in the annular space in known manner.

The comb plates 4 in this arrangement are mounted on the outer mould member 2. The helical coils of a continuous length of wire is positioned within the outer mould before installation of the inner mould 1 and the coils allowed to freely expand into the spaces 5 in the comb plates 4. The wire is locked into the space 5 by the insertion of another dividing plate 6. The wires are not necessarily positioned concentrically of the pipe segments nor do the segments necessarily form a perfect circle. In order to achieve greater strength, it has been found desirable in tests to increase the thickness of the concrete wall at selected points on the circumference.

FIG. 4 shows a cross-sectional view of one desirable concrete form and positioning of tendons therein. The drawing shows a thickening of concrete at top and bottom portions for greater strength whilst the tendons in this area are positioned adjacent to the internal surface of the pipe, and positioned adjacent the outer surface at those areas of the pipe destined to form the sides of the pipe when in use.

The tendon is coated with an anti-bonding material which prevents the concrete from contacting the tendon. The anti-bonding material reduces the friction between the tendon and the concrete, permitting low friction relative circumferential movement of the tendon with respect to the cured concrete. The anti-bonding material can be of one or more layers. It can be of materials such as silicone wax, or can be metal or plastic. There are, however, several requirements for the anti-bonding material and its relationship with the tendon. First, the inner surface of the anti-bonding material must be in close contact with the outer surface of the tendon, with essentially no gaps therebetween. This is so there can be no relative radial movement between the tendon and the coating. By way of example, the anti-bonding material can be applied to the outer surface of the tendon by painting, spraying, or dipping, or it can be extruded about the tendon. Second, the anti-bonding material must be strong enough to withstand without failure the pressures placed upon it by the stressed tendon. By failure is meant a forcing or migration of excessive amounts of the anti-bonding material from beneath the tendon in the face of pressure. If there is excessive failure of the anti-bonding material thereby allowing the tendon to contact the concrete, line contact at very high pressures will be established, and the friction will be greatly increased. It is important that the area over which the force is applied be maximized to reduce the pressure. Advantageously, the radius of the outer surface of the anti-bonding material is only slightly greater than that of the tendon. That is, a thin, strong coating of anti-bonding material is utilized. The closer the radius of the tendon to the coating, the greater the area over which the force is applied. It is also important that there be no gaps between the outer surface of the anti-bonding material and the concrete, for the same reasons as expressed above with regard to the relationship between tendon and coating. When a thin coating is used, the radius of the inner surface of the concrete is also only slightly greater than that of the outer surface of the tendon, and thus the area over which the force is applied from the tendon to the concrete is also maximized.

Referring to FIG. 7 of the drawings, an end of a tendon 3 is shown having a mild steel sleeve 45 positioned thereon. After positioning of the sleeve 45, the end of the tendon 3 is deformed to form a button-like enlargement 46 for securing the sleeve on the end of the tendon. After positioning of the tendons in the annular space of the mould mentioned previously, the sleeve 45 may be welded to a part of the reinforcing members if inserted in the mould. The sleeve 45 and button 46 act to form an anchor in the cured concrete moulding to allow stressing of the tendon.

The concrete can be moulded either in a vertical mould or on a horizontal axis by well known centrifugal casting methods. The vertical arrangement is preferred, and is described and illustrated herein, however, it should be understood that the claims are not limited to the specific moulding method employed.

The cylinder in segment form may be expanded to stress the tendons by any convenient method, however, there is always the possibility of breakage of concrete and care must be exercised during the expansion and tensioning of the tendons.

Referring to FIG. 3 of the drawings, a large flexible open-ended bag 20 substantially conforming to the internal diameter of the cast segmented cylinder is arranged therein in association with a rigid core member 21. The base is sealed at the ends against the core member 21 by encircling band 23. A filler band 24 is positioned to fill the ends. The space therebetween filled with hydraulic fluid such as water under pressure. Fluid is admitted through pipe 22. Thus, the heavy walled tube is expanded against the inner wall of the segmented cylinder. The sealing at the ends prevents leakage of fluid at the ends and also prevents extrusion of the bag material as the cylinder expands in diameter. Preferably, a thin sheath of fibre glass 25 or like material envelops the bag material to prevent abrasion against the internal surface of the concrete segments and also minimise undue extension of the bag material near the ends. The core member 21 is filled with concrete to form a rigid base.

As the diameter of the pipe increases the comb plates can be removed, one section radially outwardly and the other section from the end of the pipe. An expanding mandrel (not shown) may be placed inside the segmented concrete cylinder lined with soft material to cushion and spread the forces applied by expansion of the mandrel. When radial outward force is applied by the mandrel a small gap is opened up between the segments to stress the tendon.

Alternatively, a large bag (not shown) may be positioned between a former and the segmented concrete cylinder in the manner of a tyre tube. To retain the bag at the open ends of the cylinder, stop plates are provided at each end to completely enclose the bag which may be filled under pressure to expand the concrete cylinder.

It is envisaged that the total increase in the width of the gaps between say four longitudinal segments of a 4 foot diameter cylinder when expanded will be about 1 inch with the stressing force applied. That is to say, with four segments each gap increase would be about 174 inch. The gaps so produced can be formed up and a suitable filler 26 injected therein as shown in FIG. 5. The filler may be cement or epoxy resin or the like. After curing of the filler, the strands segments are prevented from moving radially inwardly and the tendons will remain under tension after release of the radial force on the inside of the cylinder.

Preferably, the tendons are wound on a helix of approximately 1 inch pitch. However, it is envisaged that the pitch may vary considerably. It will be appreciated that the completed cylinder is stressed with the tendons totally enclosed by stressed concrete with gaps between longitudinal segments being filled with filler material. Equipment utilised to mould the concrete and stress the tendons can be comparatively simple in construction and, accordingly, the entire casting and stressing operation can be carried out in situ thereby avoiding or reducing cartage costs and handling. Conveniently, the gaps are filled with settable material, however, non-settable materials such as plastics, wood, metals or plastic coated metals may be used.

Outer protective layers are not required after production is completed because the tendons are already totally embedded. If cracking of the concrete segments occurs, but the stressed tendons do not fail, the cracks will be self-repairing due to autogenic healing. Furthermore, it will be appreciated that, in the vicinity of the gaps between the segments, the tendons may act in the manner of a hinge thus giving flexibility to the completed structure which is not possible with existing reinforced prestressed pipes known to Applicant.

Reports of tests carried out on test length of pipes made in accordance with the invention will now be described.

| Product Specification | |
|---|---|
| Pipe Ring | 55½ inch outside diameter<br>48 inch inside diameter<br>1 foot long |
| Prestressing Wire | 0.276 inch diameter |
| Pitch Circle Diameter of Wire | 52.25 inch |
| Pitch of Wire | 0.75 inch (15 wires) |
| Number of Segments | 4 |
| Wire Release Agent | Silicone Wax |

Concrete 8 bags of Portland Cement per Cubic Yard
4:1 Aggregate/Cement Ratio

Strength 8000 p.s.i. test at 28 days after pouring
Slump approx. 2 inch.
6, Aggregate — Bacchus Marsh (Victoria) river gravel.

Method of Expansion

The pipe ring was placed over a solid concrete core 42 inch diameter. An inner tube was placed in the annular space between the inside surface of the ring and the solid core. Steel plates were bolted to the core to retain the tube in the annular space. Water was then introduced into the rubber tube causing the pipe ring to expand. A steel plate was placed across the four joints to prevent the inner tube distending through the gap caused by the expansion of the pipe ring segments.

Results

Readings were taken of the increase in the gap between the segments. These were recorded at 50 p.s.i. intervals and are set out below.

| Test Pressure | Joint No. 1 | 2 | 3 | 4 |
|---|---|---|---|---|
| 100 | 1/32 | 1/32 | 1/32 | 1/32 |
| 150 | 3/64 | 1/16 | 3/64 | 1/16 |
| 200 | 1/16 | 5/64 | 5/64 | 5/64 |
| 250 | 3/32 | 7/64 | 3/32 | 7/64 |
| 300 | 7/64 | 1/8 | 1/64 | 1/8 |
| 350 | 5/32 | 5/32 | 1/8 | 1/8 |
| 400 | 5/32 | 3/16 | 11/64 | 5/32 |
| 450 | 11/64 | 13/64 | 11/64 | 3/16 |
| 500 | 7/32 | 7/32 | 13/64 | 1/32 |

Total or aggregate gap width is approximately 0.86 inch at 500 p.s.i. which represents approximately 10,300 lb. tension per wire or approximately 172,000 p.s.i. in the steel wires of the test ring.

It can be calculated in this Example that neglecting friction between the wires and the concrete segments, extension of the wire would be 1.14 inch. From the above figures, the loss of extension due to friction amounts to 0.28 inch which is considered quite low and satisfactory. This represents a loss due to friction of approximately 30%. After stressing the open joints between segments were filled with dry packed cement one instance and epoxy resin in others. The ring was not loaded.

EXAMPLE 2

| Product Specification | |
|---|---|
| Pipe Ring | 55½" OD × 48" ID × 12" LG. |
| Diameter of Prestressing wire | −0.276" (positioned elliptically) |
| Major diameter of ellipse | = 53" |
| Minor diameter of ellipse | = 50.5" |
| No. of turns of wire | = 11 (1.00" pitch) |
| No. of segments | = 4 |
| Wires stressed to 64% U.T.S. = 8400 lb. each | |
| Wire Release Agent - Silicone Wax | |
| Extension of Wires due to Prestress = .75" | |
| Internal Fluid Pressure at transfer = 320 p.s.i. | |

Concrete

2-½:1 aggregate cement ratio
5000 p.s.i. at 7 days (steam cured)
Slump approximately 2 inches
Aggregate — Bacchus Marsh river gravel

Method of Expansion

As for Example 1. Joints were filled with epoxy filler after stressing. On the basis of the above figures, the loss of prestress due to friction between the wire and segments was only approximately 7%.

Method of Testing and Results

The pipe ring was set up in a testing machine capable of simulating overburden loading on a pipe with the major axis of the elliptically positioned prestressed wire horizontal and the axis of the ring horizontal. Load was applied to the top of the ring. The load was applied and released 3 times to a figure of 6000 lb.

Ring was then loaded a fourth time to 9,600 lb. and held. After 50 sec. circumferential cracks appeared in the pipe wall following approximately the line of the elliptical wires.

The pipe was then reloaded to the ultimate fracture load of 11,250 lb.

Conclusion

The results obtained were equivalent to a 1.5Z (Australian Standard Specification for drainage pipes) class reinforced concrete pipe which has a wall thickness of approximately 4⅜ inch and a concrete strength of approximately 10,000 p.s.i. These figures compare with the test ring of 3.75 inch thickness and concrete strength of 5,000 p.s.i.

EXAMPLE 3

| Product Specification | |
|---|---|
| Ring | 55½" OD × 48" ID × 12" length |
| Diameter of Prestressing wire | 0.276" |
| Major diameter | = 53" |
| Minor diameter = 50.5" | |
| No. of turns of wire | = 8 (1.5" pitch) |
| No. of segments | = 4 |
| Wire stressed to 8000 lb. each (60% U.T.S.) | |
| Wire release agent - Silicone Wax | |
| Extension of Wires due to Prestress = .75" | |
| Internal Fluid Pressure at transfer = 220 p.s.i. | |

Concrete

6 : 1 aggregate cement ratio
5000 p.s.i. at 2 days (Ciment Fondu)

Method of Expansion

As for Example 2. Losses due to friction again was approximately 7%.

Method of Testing

As for Example 2.

Results

Ultimate failure load of 14,400 lb. No cracking visible at 6,400 lb. (load held for 1 minute).

The positioning of the wires in this example was similar to that shown in FIG. 4. This test indicates that a prestressed pipe having considerably less concrete and having a considerably lower strength (5000 p.s.i.) had a superior ultimate failure load of 14,400 lb. when compared with 1.5Z class reinforced pipe mentioned previously.

Accordingly, the pipe is lighter and more easily transportable. Also, manufacturing costs are reduced since low strength concrete is easier to place and requires a lower cement aggregate ratio.

Having reference to FIG. 6, the wire may be prestressed by winding on to a strong segmented metal cylinder 40, this wire is anchored and the cylinder radially expanded as by hydraulic jacks 41. Thus the wire is tensioned and the gaps between the segments are held apart by chocks 42. The jacks can then be removed and the force applied by the stressed wire is applied to the chocks 42. The segmented cylinder and stressed wire is placed in a vertical mould similar to that shown in FIG. 1.

Of course, the comb plates are not required in this construction. Upon molding and curing of the concrete, the pipe is removed from the mould and the chocks are removed and the tension in the wire is then applied to the concrete. The metal segments remain embedded in the concrete.

I claim:

1. A method of producing a concrete pipe comprising the steps of:

substantially continuously coating a stressable tendon with an anti-bonding material, the inner radius of the anti-bonding material being substantially equal to the outer radius of the tendon, such that the outer surface of said tendon closely contacts the inner surface of said anti-bonding material with no gaps present therebetween, said anti-bonding material being of sufficient strength to withstand without failure the compressive load applied thereupon by said tendon to preclude relative radial movement of said tendon with respect to said coating material to the point where said tendon contacts said concrete while assuring low friction relative circumferential movement of said tendon with respect to the cured concrete, installing at least one coated unstressed tendon in a concrete pipe mould prior to pouring of concrete, the tendon extending substantially concentrically relative to the walls of the mould and being secured to tendon anchorages positiond within the mould, said mould having at least one longitudinal divider so that the pipe to be cast therein has at least one longitudinal split, portions of said tendon lying on both sides of said split and being connected together across said split, pouring concrete into said mould to substantially completely immerse said tendon and said anchorages in said concrete except for those points wherein said tendon passes through said longitudinal split, so that concrete surrounds and intimately contacts said coating material with no gaps therebetween to preclude relative radial movement of said coating material with respect to said concrete after curing the concrete in the mould, expanding said pipe radially outwardly to cause circumferential movement of said tendon with respect to the cured concrete to thereby stress the tendon, and filling the split in said pipe with a filler to form a substantially continuous stressed cylinder.

2. The method of claim 1 wherein the radius of the outer surface of said coating material is slightly greater than the radius of the outer surface of said tendon.

3. The method of claim 1 wherein said tendon is helically disposed.

4. A method of stressing a substantially circular tendon comprising the steps of:

substantially continuously coating a stressable tendon with an anti-bonding material such that the outer surface of said tendon intimately contacts the inner surface of said anti-bonding material with no gaps present therebetween, said anti-bonding material being of sufficient strength to withstand without failure the compressive load applied thereupon by said tendon to preclude relative radial movement of said tendon with respect to said coating material to the point where said tendon contacts said concrete while assuring low friction relative circumferential movement of said tendon with respect to the cured concrete, installing at least one coated unstressed tendon in a concrete pipe mould prior to pouring of concrete, the tendon extending substantially concentrically relative to the walls of the mould and secured to tendon anchorages positioned within the mould, said mould having at least one longitudinal divider so that the pipe to be cast therein has at least one longitudinal split, portions of said tendon lying on both sides of said split and being connected together across said split, pouring concrete into said mould to substantially completely immerse said tendon and said anchorages in said concrete except for those points wherein said tendon passes through said longitudinal split, so that concrete surrounds and intimately contacts said coating material with no gaps therebetween to preclude relative radial movement of said coating material with respect to said concrete after curing the concrete in the mould, expanding said pipe radially outwardly to cause circumferential movement of said tendon with respect to the cured concrete to thereby stress the tendon, and filling the split in said pipe with a filler to form a substantially continuous stressed cylinder.

5. The method of claim 4 wherein the radius of the outer surface of said coating material is slightly greater than the radius of the outer surface of said tendon.

6. The method of claim 4 wherein said tendon is helically disposed.

7. A method of producing a concrete pipe comprising the steps of:

substantially continuously coating a stressable tendon with an anti-bonding material such that the outer surface of said tendon closely contacts the inner surface of said anti-bonding material with no gaps present therebetween, said anti-bonding material being of sufficient strength to withstand without failure the compressive load applied thereupon by said tendon to preclude relative radial movement of said tendon with respect to said coating material to the point where said tendon contacts said concrete while assuring low friction relative circumferential movement of said tendon with respect to the cured concrete, installing at least one coated unstressed tendon in a concrete pipe mould prior to pouring of concrete, the tendon extending substantially concentrically relative to the walls of the mould and being secured to tendon anchorages positioned within the mould, pouring concrete into said mould to substantially completely immerse said tendon and said anchorages in said concrete so that concrete surrounds and intimately contacts said coating material with no gaps therebetween to preclude relative radial movement of said coating material with respect to said concrete after curing the concrete in the mould, providing said pipe with a longitudinal split in the concrete thereof for at least a considerable portion of the length of said pipe, portions of said tendons lying on both sides of said split and being connected together across said split, expanding said pipe radially outwardly to cause circumferential movement of said tendon with respect to the cured concrete to thereby stress the tendon and to cause any concrete bridging said split or longitudinally aligned therewith to be severed, and filling the split in said pipe with a filler to form a substantially continuous stressed cylinder.

8. The method of claim 7 wherein the radius of the outer surface of said coating material is slightly greater than the radius of the outer surface of said tendon.

9. The method of claim 7 wherein said tendon is helically disposed.

* * * * *